US005175562A

United States Patent [19]

Rappaport

[11] Patent Number: 5,175,562

[45] Date of Patent: Dec. 29, 1992

[54] HIGH APERTURE-EFFICIENT, WIDE-ANGLE SCANNING OFFSET REFLECTOR ANTENNA

[75] Inventor: Carey M. Rappaport, Boston, Mass.

[73] Assignee: Northeastern University, Boston, Mass.

[21] Appl. No.: 695,738

[22] Filed: May 6, 1991

Related U.S. Application Data

[63] Continuation-in-part of Ser. No. 370,701, Jun. 23, 1989, abandoned.

[51] Int. Cl.[5] ..... H01Q 19/12

[52] U.S. Cl. ..... 343/840; 343/912; 343/914

[58] Field of Search ..... 343/840, 912, 775, 779, 343/781 R, 914, 835

[56] References Cited

U.S. PATENT DOCUMENTS

| | | | |
|---|---|---|---|
| 3,573,833 | 4/1971 | Ajioka et al. | 343/753 |
| 3,914,768 | 10/1975 | Ohm | 343/779 |
| 3,922,682 | 11/1975 | Hyde | 343/761 |
| 3,936,837 | 2/1976 | Coleman et al. | 343/781 |
| 3,969,729 | 7/1976 | Nemit | 343/756 |
| 3,995,275 | 11/1976 | Betsudan et al. | 343/781 CA |
| 3,996,590 | 12/1976 | Hammack | 343/112 R |
| 4,144,535 | 3/1979 | Dragone | 343/756 |
| 4,145,695 | 3/1975 | Gans | 343/779 |
| 4,150,379 | 4/1979 | Connors | 343/100 |
| 4,187,508 | 2/1980 | Evans | 343/770 |
| 4,198,639 | 4/1980 | Killion | 343/727 |
| 4,201,992 | 5/1980 | Welti | 343/840 |
| 4,203,105 | 5/1980 | Dragone et al. | 343/781 P |
| 4,232,322 | 11/1980 | De Padova et al. | 343/781 P |
| 4,250,508 | 2/1981 | Dragone | 343/779 |
| 4,266,858 | 12/1986 | Copeland | 342/374 |
| 4,272,769 | 6/1981 | Young et al. | 343/781 P |
| 4,298,877 | 11/1981 | Sletten | 343/781 CA |
| 4,339,757 | 7/1982 | Chu | 343/781 P |
| 4,342,997 | 8/1982 | Evans | 343/16 R |
| 4,353,073 | 10/1982 | Brunner et al. | 343/779 |
| 4,365,253 | 12/1982 | Morz | 343/786 |
| 4,398,200 | 8/1983 | Meier | 343/756 |
| 4,419,670 | 12/1983 | Hill | 343/779 |
| 4,448,156 | 12/1984 | DuFort et al. | 343/754 |
| 4,462,034 | 7/1984 | Betsudan et al. | 343/761 |
| 4,477,816 | 10/1984 | Cho | 343/786 |
| 4,482,897 | 11/1984 | Dragone et al. | 343/779 |
| 4,516,133 | 5/1985 | Matsumoto et al. | 343/819 |
| 4,521,783 | 6/1985 | Bryans et al. | 343/781 |
| 4,564,935 | 1/1986 | Kaplan | 370/38 |
| 4,584,588 | 4/1986 | Mohring et al. | 343/786 |
| 4,626,863 | 12/1986 | Knop et al. | 343/781 P |
| 4,638,322 | 1/1987 | Lamberty | 343/761 |
| 4,646,102 | 2/1987 | Akaeda et al. | 343/915 |
| 4,665,401 | 5/1987 | Garrard et al. | 342/75 |
| 4,673,905 | 6/1987 | Yamawaki et al. | 333/239 |
| 4,689,632 | 8/1987 | Graham | 343/781 P |
| 4,716,417 | 12/1987 | Grumet | 343/708 |
| 4,724,439 | 2/1988 | Wiley et al. | 342/351 |
| 4,731,144 | 3/1988 | Kommineni et al. | 156/245 |
| 4,750,002 | 6/1988 | Kommineni | 343/915 |
| 4,755,826 | 7/1988 | Rao | 343/781 P |
| 4,757,323 | 7/1988 | Duret et al. | 343/756 |
| 4,769,646 | 9/1988 | Raber et al. | 343/753 |
| 4,783,664 | 11/1988 | Karikomi et al. | 343/781 P |

*Primary Examiner*—Rolf Hille
*Assistant Examiner*—Hoanganh Le
*Attorney, Agent, or Firm*—Weingarten, Schurgin, Gagnebin & Hayes

[57] ABSTRACT

A single offset reflector antenna is disclosed which provides ±30° of horizontal scanning and 0° to +15° of vertical scanning without aperture blockage, while maintaining high aperture efficiency, and 0° to −30° of vertical scanning with moderate aperture blockage. The sufrace of the reflector antenna is described by a sixth order polynomial equation. Curvature of the horizontal cross-section of the surface taken through its center is determined by a fourth order even polynomial expression with coefficients that are found by a numerical minimization technique. Further terms, including terms of up to sixth order and their associated coefficients obtained by the numerical minimization technique, define the curvature of the vertical cross-sections of the surface to yield a three-dimensional unitary reflecting surface.

14 Claims, 15 Drawing Sheets

HIGH APERTURE-EFFICIENT, WIDE-ANGLE SCANNING OFFSET REFLECTOR ANTENNA

CROSS-REFERENCES TO RELATED APPLICATIONS

This application is a continuation-in-part of U.S. patent application Ser. No. 07/370,701, filed Jun. 23, 1989, now abandoned.

FIELD OF THE INVENTION

This invention relates to single reflector antennas, and particularly to single reflector antennas with high aperture efficiency, wide scanning angle, and reduced aperture blockage.

BACKGROUND OF THE INVENTION

Microwave reflector antennas have long been used as the primary means for transmitting and receiving high frequency communication signals. Most reflectors are parabolic, with a single focal point. Incoming plane waves falling within the aperture of the antenna are reflected by its conducting metal surfaces and are thereby directed to this focal point. According to the principle of reciprocity, waves originating from a feed (transmitter/receiver) located at the focal point will be reflected by the metal surfaces to form an outgoing plane wave without phase error. Thus, a parabolic (or paraboloidal) reflector surface can be used to produce a collimated, highly directive beam from a non-directive, omnidirectional "point" source. Energy radiated uniformly from a point source located at the focal point will reflect off of a perfectly conducting paraboloidal antenna surface and travel in the direction of the axis of revolution of the surface, i.e., along an axis of symmetry called the boresight direction.

Incoming beams that arrive at a non-zero angle with respect to the boresight direction and are subsequently reflected by the antenna surface to a feed at a feed point are said to be scanned. Conversely, when a feed is displaced from the focal point to a feed point, the outgoing transmitted beam is angularly displaced, i.e., scanned with respect to the boresight direction. In this case, the field of an outgoing beam at the parabolic reflector aperture contains non-planar phase errors. These errors result in a degraded outgoing beam with reduced peak gain, increased sidelobe levels, and filled nulls, where peak gain is a parameter that represents the strength of a transmitted beam as measured at its center, and sidelobe levels and filled nulls represent a measure of undesirable cross-talk. For this reason, the effective field of view of a paraboloidal reflector antenna is limited to only a few beamwidths of scanning, where a beamwidth represents a measure of angular displacement, and the effective field of view is defined as the greatest angle, typically expressed in beamwidths, at which beams can be scanned without being excessively degraded. With a typical focal length to aperture diameter ratio (F/D) of 0.5, a parabolic reflector antenna yields a peak gain scan loss of at least 10 dB at 20 half-power beamwidths, which corresponds to a field of view of about ±5° for a medium quality beam, i.e., a beam at 50% peak gain.

Attempts have been made to improve single reflector scanning capability by considering deformed geometries based on the sphere or parabolic torus. To maintain acceptable beam quality, typically only a small portion of the much larger reflector area is illuminated by any single beam, where each beam is characterized by a different angle with respect to the boresight direction. Most of the reflector is unused unless close multiple beams are employed. Thus, although the scanning capability of these deformed geometries is better than the scanning capability of a paraboloid, the aperture efficiency becomes very low, where aperture efficiency is the ratio of usable reflector area per beam to the area of the entire reflector aperture.

Scanning dual reflectors are known which require two shaped metal surfaces and suffer from aperture blockage. There are also shaped single parabolic and single non-parabolic reflectors, where the shaped single parabolics are limited to about ±10° of scanning, while the single non-parabolic reflectors, including a torus, an ellipsoid, and the spherical cap mentioned above, suffer from low aperture efficiency. Since reflector size is often limited by spacecraft payload volume, a reflector of small size and high aperture efficiency is extremely desirable.

A symmetric scanning single reflector surface with two shaped portions joined in a continuous fashion, as described in copending U.S. patent application Ser. No. 07/370,701, of which the present application is a continuation-in-part, avoids many of the above-mentioned problems. This surface is obtained in two general steps: the coefficients b, $r_1$, and $r_2$ of a fourth-order profile curve $z_1=-b+r_2z^4$ in the scan plane are found using a numerical minimization technique to minimize the scanned beam error. Then, polynomial terms of even order $z_2=Py^2+Qx^2y^2+Ry^4+Sy^2x^4$ are added to form a three dimensional surface given by the expression $Z_s=z_1+z_2=-b+r_1x^2+r_2x^4+Py^2+Qx^2y^2+Ry^4+Sy^2x^4$, where the coefficients P, Q, R, and S are found using a numerical minimization technique to provide minimum astigmatism and coma for both the unscanned and maximally scanned beams.

Although this antenna surface $Z_s$ has the advantages of high aperture efficiency and good focusing over a wide range of scan angles, the surface requires that the feeds be disposed in a region that blocks the aperture window. Aperture blockage results in reduced gain and sensitivity, thereby impairing the performance of the antenna to a significant extent. In a single feed reflector antenna, aperture blockage by the feed is a problem; with a multiple-feed antenna, the problem is compounded.

In the art of paraboloidal reflector antennas, it is known to illuminate an offset portion of the antenna surface, i.e., a portion of the paraboliodal surface which does not include its axis of revolution. The feed is aimed up at the reflector, but is still located at the paraboloidal focal point, so rays are still collimated along the boresight direction. This allows the same performance as a standard paraboloidal reflector antenna with a feed directed at the antenna vertex, while eliminating feed blockage. However, scanning is still quite limited, and peak gain for scanned beams is compromised.

The symmetrical scanning antenna disclosed in copending U.S. patent application Ser. No. 07/370,701 includes a reflector surface that has been optimized over a region near the plane of feeds, with its non-ideal shaping increasing with distance from this plane. However, illuminating an offset portion of this surface would result in large phase errors and beam degradation.

SUMMARY OF THE INVENTION

A single offset reflector antenna is disclosed that includes an offset antenna surface and an associated antenna feed array region which together provide good beam performance for all beams orientations within a wide-angle field of view. Since an offset approach is used, feed blockage is substantially reduced. The aperture for the boresight beam substantially overlaps the aperture for all scanned beams from −30° to +30°, resulting in a higher aperture efficiency. In particular, the single offset reflector antenna provides ±30° of horizontal scanning and 0° to +15° of vertical scanning without aperture blockage, while maintaining high aperture efficiency, and 0° to −30° of vertical scanning with moderate aperture blockage. The surface of the reflector antenna is described by a sixth order polynomial equation. Curvature of the surface in the horizontal cross section through its center is determined by a fourth Order even polynomial with coefficients that are found by a numerical minimization technique. Further terms of up to sixth order, and their associated coefficients obtained by the numerical minimization technique, define the curvature of the surface in the vertical cross sections to yield a three-dimensional unitary reflecting surface. However, unlike the case of an offset paraboloid, the reflecting surface of the invention is not merely an offset portion of a corresponding symmetric surface.

The reflector antenna of the invention provides very good results for all beams within the ±30° horizontal by −30° to +15° vertical field of view, with peak gain typically no more than 1.5 dB below ideal, and highest sidelobe levels from 9.0 to 14.0 dB below the peak gain. The best horizontal scanning performance is along the 0° vertical elevation arc, but quite acceptable beams can be formed at as much as 30° above this arc. Offsetting the feed array assembly avoids blockage of the outgoing beam. The single offset reflector antenna has better scan performance than comparably sized paraboloid and torus surfaces, and is more compact, and thus should find numerous uses in both spacecraft and terrestrial applications.

DESCRIPTION OF THE DRAWING

The invention will be more fully understood from the following detailed description, in conjunction with the accompanying figures, in which.

DETAILED DESCRIPTION OF THE PREFERRED EMBODIMENT

Figure 1:
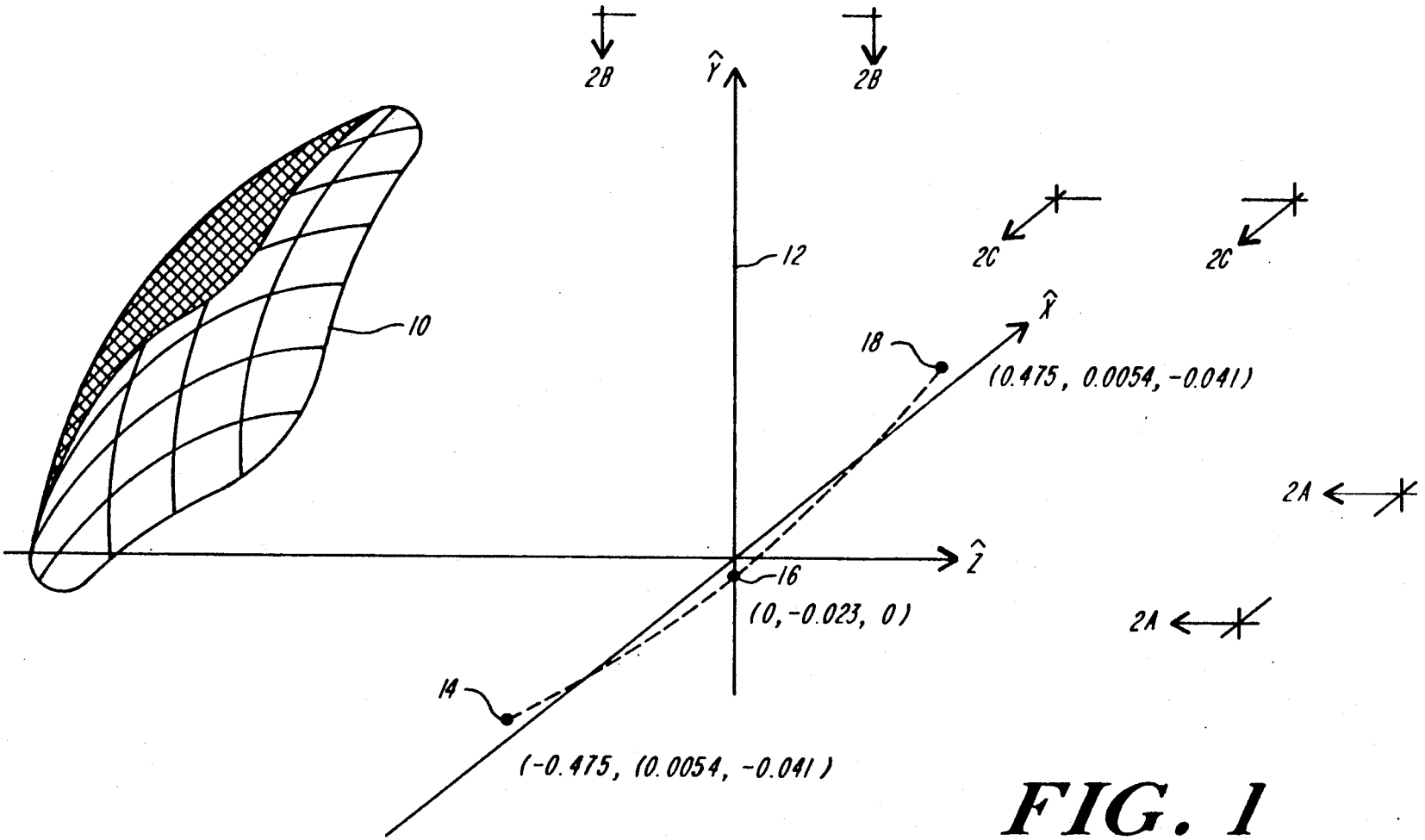
FIG. 1 is an oblique view of the offset reflector surface and three exemplary feeds in three dimensions.

With reference to FIG. 1, a single offset reflector surface 10 is defined to be a function z of x and y in three-dimensional space determined by a coordinate system 12 with X, Y, and Z axes. The surface 10 is symmetric about the Y-Z plane where x=0. Both horizontal and vertical scanning is accomplished using feeds 14, 16, 18 located generally in the X-Y plane, although FIGS. 2B, 2C, and 3 show that for points farther away from x=0, the feeds 14 and 18 are also displaced along the Z-axis and out of the X-Y plane. The horizontal scanning component is along the X-axis, and the vertical scanning component is along the Y-axis.

Figure 2A:
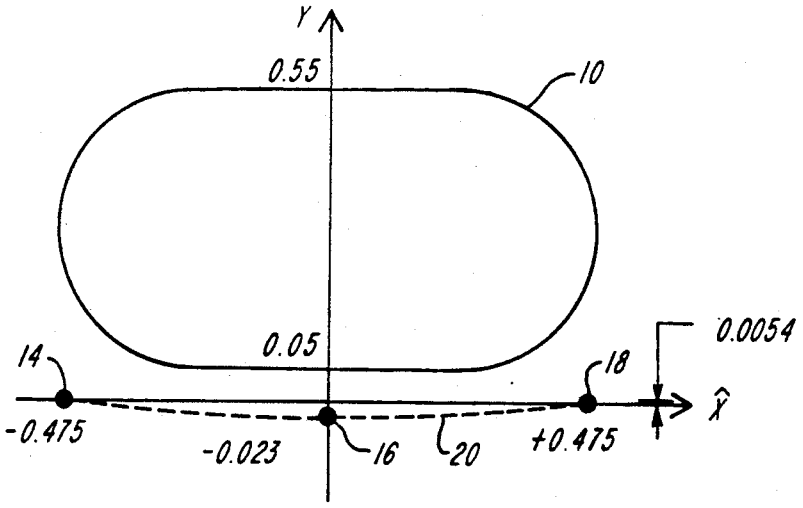
FIGS. 2A–2C are plan views taken along the Z, Y, and X axes, respectively, of the coordinate system of FIG. 1.
Figure 2C:
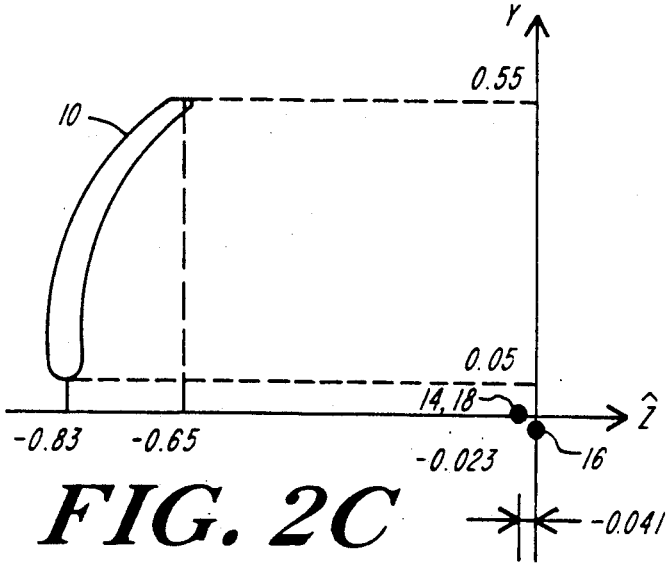
Figure 2B:
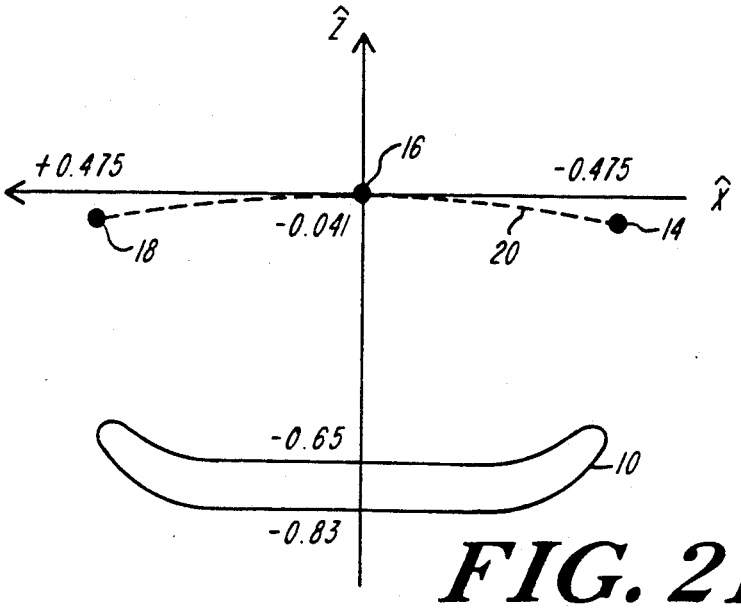
Figure 3:
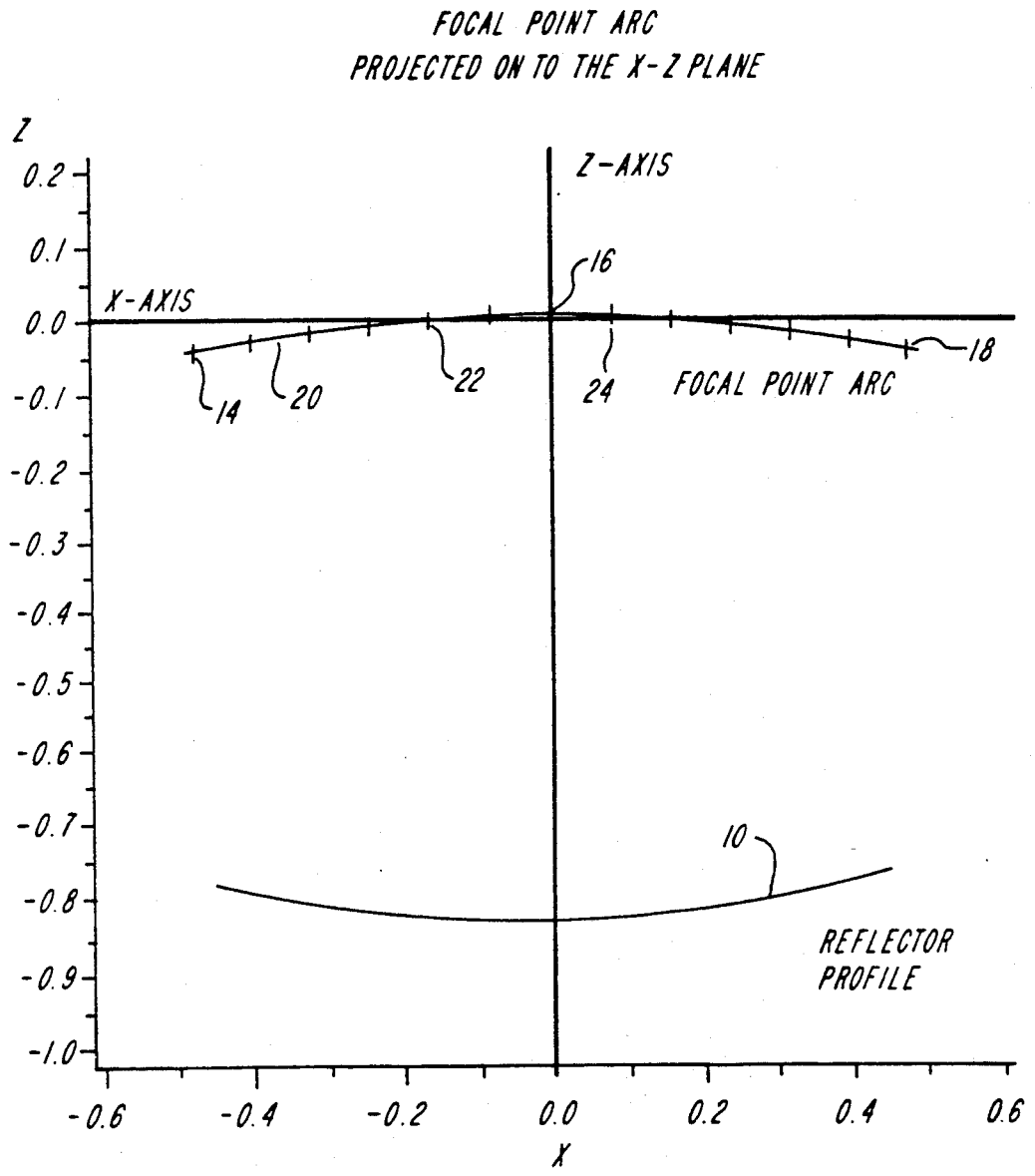
FIG. 3 is a high resolution cross-sectional vie the offset reflector surface taken along the Y-axis at y=0 to FIG. 2B, and showing a feed point arc projected on the X-Z plane.

Referring to FIGS. 2A–2C, each number, such as 0.55 in FIG. 2A near the Y-axis, represents a distance in arbitrary dimensionless relative units along that axis from the origin of the coordinate system 12 to the point where the feature intersects with the axis, or where its projection onto the axis intersects with the axis. For example, the feed point 18 is disposed 0.475 relative units along the X-axis. Dimensions of an actual antenna surface and the placement of its feeds can be calculated by multiplying each relative unit by a scale factor with linear dimensions. To obtain the dimensions of an antenna suitable for transmitting and receiving signals with a wavelength of 10 cm, i.e., microwave radiation, for example, each number in relative units is multiplied by 600 cm/unit.

Figure 4:
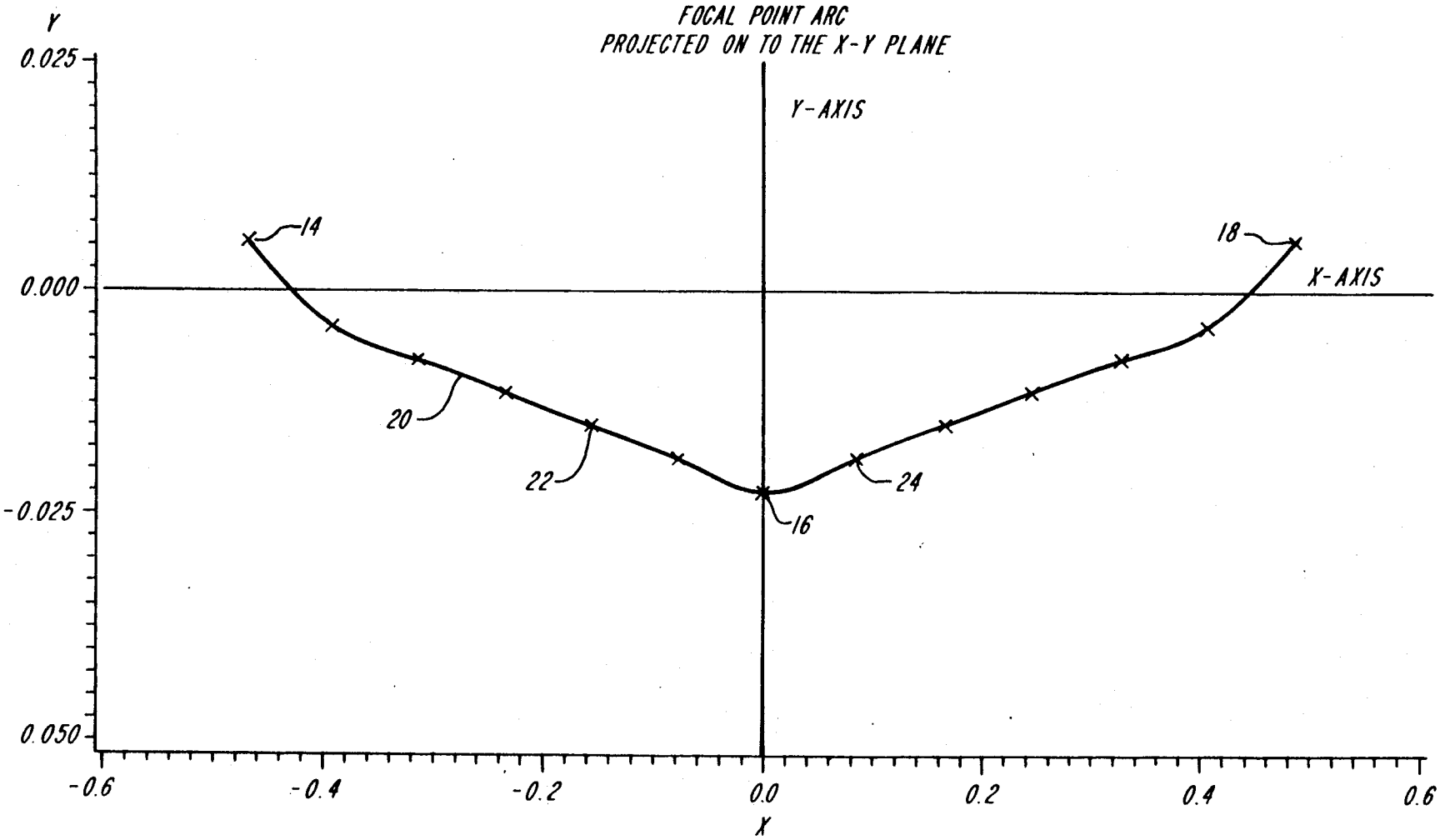
FIG. 4 is a high resolution view showing the feed point arc of FIG. 3 projected on the X-Y plane.

Referring to FIGS. 3 and 4, a focal arc 20 includes a plurality of feed points that lie within a focal region that generally surrounds the focal arc 20 of the reflector surface 10, such as the points 14, 16, 18, 22, and 24. FIG. 3 shows a projection of the arc 20 onto the x-z plane, i.e., a view along the y-axis similar to that of FIG. 2B, and FIG. 4 is a projection of the arc 20 onto the x-y plane, i.e., a view looking down from a position above the surface 10, similar to the view in FIG. 2. Since the focal arc 20 has a projective component along each of the axes X, Y, and Z, the focal arc 20 does not lie in a two-dimensional plane, instead being a curve in three-dimensional space.

With reference to FIGS. 1 and 2C, since the focal arc 20 of the surface 10 is chosen to be near the $y=0$ plane, the surface 10 must be disposed entirely on the positive side of the $y=0$ plane to provide an offset reflector without feed blockage for scan angles between $\pm 30°$ of horizontal scanning and 0° to $+15°$ of vertical scanning. To accomplish this, the coordinate system is translated to $(x',y')=(x,y-y_0)$, where $y=y_0$ is chosen to be the central plane of the offset reflector. In the example shown in FIGS. 1 and 2, $y_0=0.3$.

The surface 10 is a function $z_{off}$ of x and y, and is described by the equation:

$$z_{off}=z_1+z_2+z_3 \tag{1}$$

where $$z_1=-b+r_1x^2+r_2x^4 \tag{2}$$

$$z_2=Py'^2+Qx^2y'^2+Ry'^4+Sx^4y'^2 \tag{3}$$

and $$z_3=Ny'+Tx^2y'+Ux^4y'+Vy'^3+Wx^2y'^3 \tag{4}$$

Although the above expressions for $Z_1$, $z_2$, and $z_3$ explicitly contain terms no higher than sixth order, higher order terms can be added without significantly affecting the reflecting properties of the surface z.

The expression for $z_1$ is the central plane profile function of the surface 10 for $y'=0$, and the expression for $z_2$ represents the even polynominal three-dimensional extension of the symmetric surface. Since the symmetry about the X-Z plane is being relaxed to obtain an offset reflector antenna, terms of odd order in y, together referred to as $z_3$, may be added. In the symmetric case, as disclosed previously in copending U.S. patent application Ser. No. 07/370,701, $y_0=0$, and therefore all coefficients of the terms odd in y' vanish, and thus $z_3$ also vanishes. Terms of even higher order than those above were considered, but were found to have little effect. Given the above equations 1–4 which generally describe the surface, the next step is to find the values of coefficients b, $r_1$, $r_2$, P, Q, R, S, N, T, U, V, and W which optimize the ability of the surface to form a beam in the boresight direction for a centrally located feed point 16, as well as the ability to form a beam which is directed 30° from boresight for another feed point, such as 14.

Figure 5:
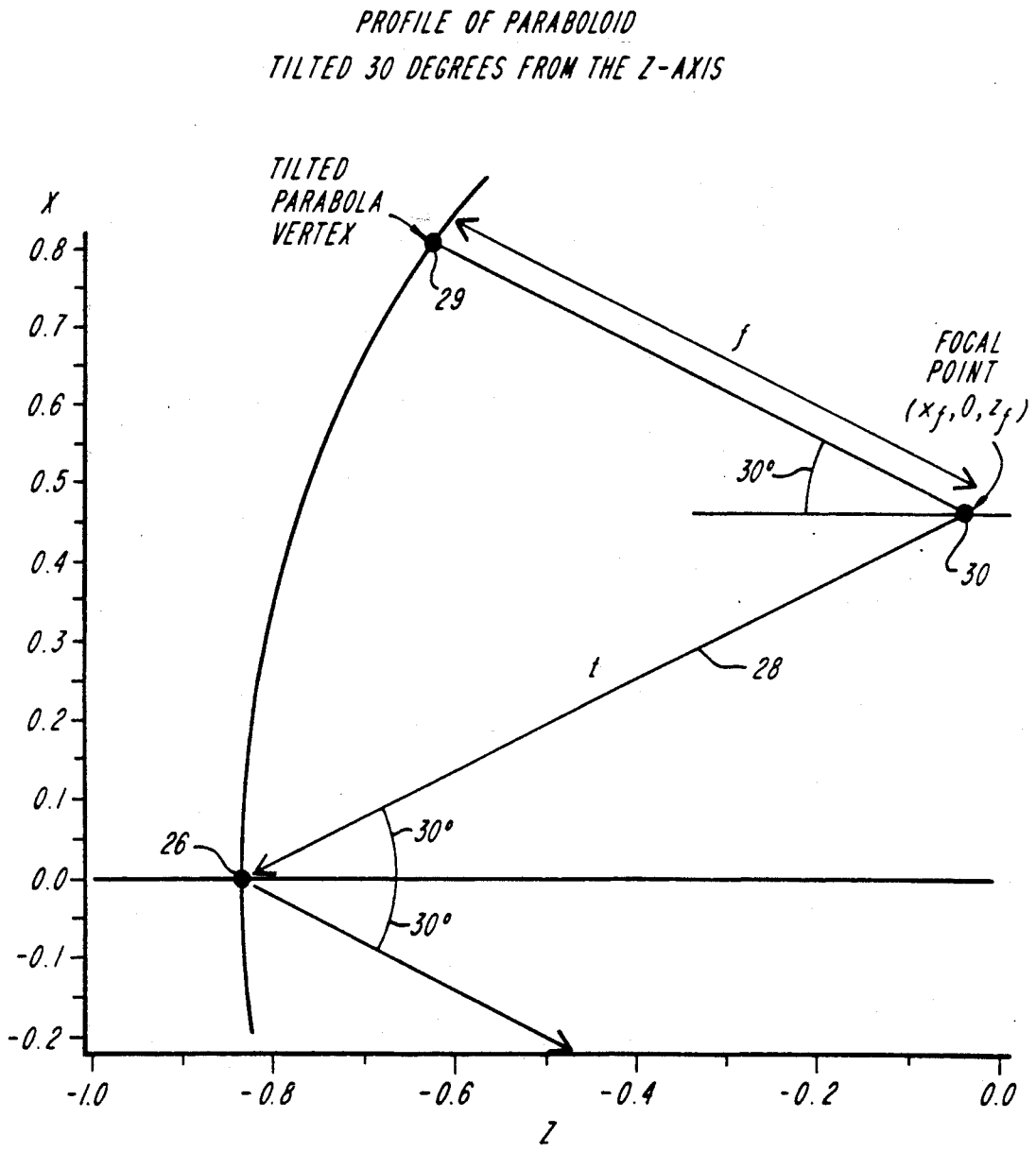
FIG. 5 is a profile in the y=0 plane of a paraboloid tilted 30° from the z-axis about the y-axis.

To find the above-mentioned coefficients, the equation describing the reflector surface 10 is matched as closely as possible using an error minimization technique, such as a least squares method, to the equations describing: 1) an untilted, or unscanned paraboloid, with outgoing rays travelling along the boresight direction (z-axis), and 2) an offset portion of a paraboloid tilted at half the field of view angle, for example, at an angle of 30°. Referring to FIG. 5, the unscanned parabola vertex 26 is taken to be at the point $z=-b$. A line 28 extended from this point at an angle of 30° to the Z-axis will cross the X-axis at the point $x=c$. If the length of the line is taken to be 1, then $b=0.866$, and $c=0.5$. The focal point of the paraboloid tilted for 30° scanning with a vertex 29 is now selected on this line 28. From the symmetric embodiment, the value $t=0.95$ is chosen to be the distance t from the surface vertex to the tilted parabola focal point $(x_f, 0, z_f)$ 30, which minimizes aberrations without resulting in an excessively large focal length to diameter ratio.

A symmetric paraboloid is described by the equation:

$$z_p - z_f = -f + \frac{1}{4f}((x-x_f)^2 + (y'-y_f)^2) \tag{5}$$

where the focal length f is the distance from the origin of the symmetric paraboloid to the vertex of the paraboloid, and the focal point is $(x_f,y_f,z_f)$. Energy generated by a source at the focal point would be collimated by such a surface and directed along the Z-axis. By contrast, the novel offset surface of the invention is based on a different, unique function of x and y, and there exists a locus of feed points corresponding to various angles of scanning, as compared with the single focal point of the symmetric paraboloid. Energy generated by a feed at each of the feed points would be collimated by the offset surface and directed along a line connecting the vertex of the offset surface and the feed point.

The equation for the tilted paraboloid can now be found by rotating the coordinate system in Equation (5) by 30° about the focal point $(x_f,y_f,z_f)=(ct,0,b(t-1))$:

$$z_t(x,y) = b(2t/c^2 - x/c - 1) - \sqrt{(2tb/c^2)^2(1-cx/t) - (y/c)^2} \tag{6}$$

To compare the offset surface to a paraboloid tilted 30°, Equation (6) must be redefined in terms of y', so $z_t(x,y')=z_t(x,y-y_0)$. Least squares analysis is used to match the offset surface profile, described by Equation (2), to that of the paraboloid described by $z_t(x,y')$ along $y'=0$. Equation (2) is subtracted from Equation (6) with $y=y_0=0.3$, and the difference is squared, sampled at 61 evenly spaced points in a chosen interval: $-0.1 \leqq x \leqq 0.5$, and summed to give the total squared error. The derivatives of the total squared error separately with respect to b, $r_1$, and $r_2$ yields three equations, each of which is set equal to zero. Solving for b, $r_1$, and $r_2$ in these three equations, yields the coefficients for the best-fitting curve, Equation (2), to the tilted parabola profile, Equation (6), with $y=0.3$.

Next, by taking the first derivative of the offset surface with respect to y' along $y'=0$, the coefficients N, T, and U of Equation (4) can be found. The equation $$\frac{\partial z_{off}}{\partial y'} = N + Tx^2 + Ux^4 \tag{7}$$

is matched again by least squares to the equation of the y'-derivative of the tilted paraboloid in Equation (6) at $y'=0$:

$$\frac{\partial z_t(x,y')}{\partial y'} = \frac{y_0}{\sqrt{(2tb)^2(1-cx/t) - c^2y_0^2}} \tag{8}$$

The $\pm 30°$ scanned feed points are initially placed at the foci of the respective tilted paraboloids—the same location as in the symmetric embodiment, $(x_f, y'_f, z_f)=(ct, -y_0, (b(t-1))$. Having found N, T, and U, the boresight feed point can now be found. However, due to the value of N calculated from the tilted paraboloid, the central in-coming ray reflected off the surface at the point $(x,y')=(0,0)$ for the unscanned beam does not cross the $y=0$ (or $y'=-y_0$) plane at the feed point. Instead, the coordinates for the unscanned feed point, calculated by moving a distance $f=\frac{1}{4}r_1$ along this central ray away from the reflector, become:

$$(x_u, y_u, z_u) = \left(0, \frac{-N}{2r_1}, z_0 + \frac{1}{4r_1} - \frac{N^2}{4r_1} + r_1 y_0^2\right) \quad (9)$$

Figure 6:
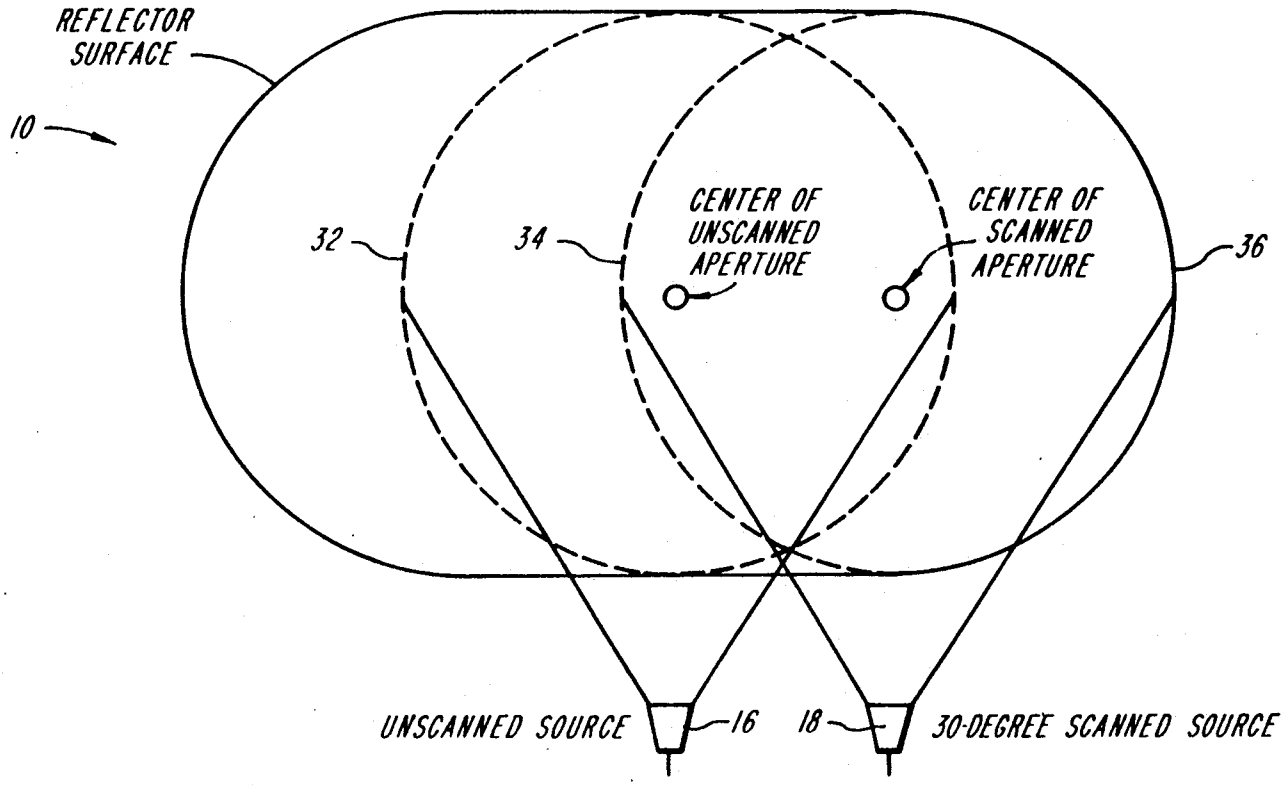
FIG. 6 is a view of three overlapping reflector surface regions illuminated by overlapping scanned and unscanned beams.

These feed points, for the boresight and scanned beams, illuminate overlapping portions of the reflector to minimize the total reflector surface area. The unscanned beam illuminates the region defined by a circle 32 chosen to have diameter 0.5 centered at $(x,y')=(0,0)$; the scanned base illuminates the region defined by an equal sized circle 34 centered at $(x,y')=(0.2, 0.0)$. The illuminated aperture circle radius is chosen to balance performance which cause larger phase errors, and a smaller radius would decrease the ratio of illuminated surface area to total surface area. These regions are shown in FIG. 6.

Figure 7:
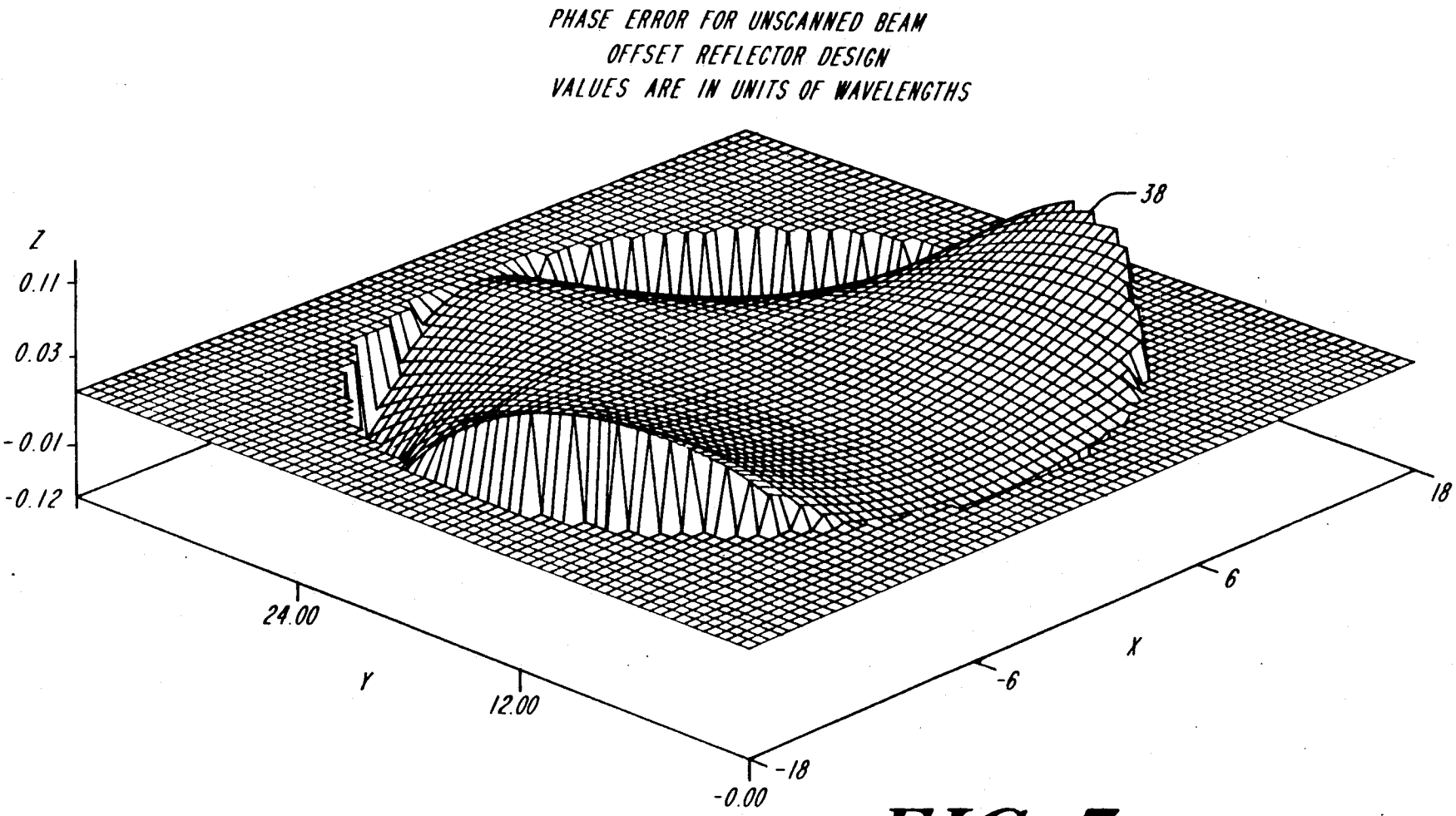
FIG. 7 is a phase error surface for an unscanned, boresight beam at the aperture plane for a 30 wavelength diameter illuminated aperture.
Figure 8:
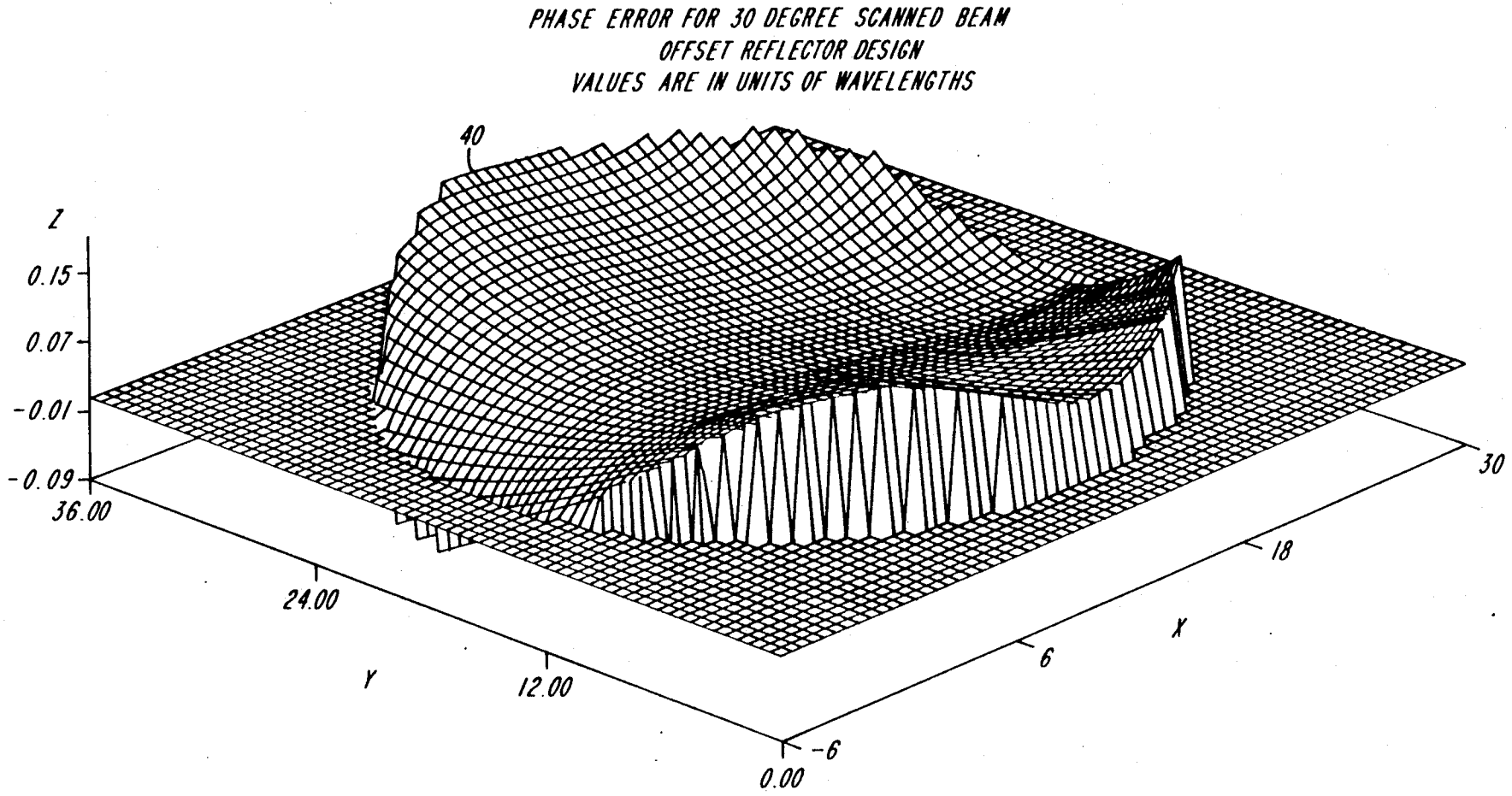
FIG. 8 is a phase error surface for a 30° scanned beam at the aperture plane for a 30 wavelength diameter illuminated aperture.

To complete the surface determination, the coefficients P, Q, R, S, V, and W must now be found. To find these coefficients, it is necessary to examine a phase error surface generated by the reflector surface for both an unscanned and a scanned beam, examples 38 and 40 of which are shown in FIGS. 7 and 8, respectively. To form a phase error surface, rays chosen to illuminate a portion of the surface defined previously are traced from the corresponding source point to the reflector surface, reflected off of the surface according to Snell's Law, and continued to an aperture plane at $z=0$. The error surface represents the total path length deviation from the ideal planar tilted wavefront over the entire illuminated aperture, and thus represents the optical aberration caused by the surface. By observing the magnitude and the shape of the errors present, the coefficients can be adjusted to minimize the path length deviation, and hence the optical aberrations. For example, astigmatism can be recognized in a phase error plot by the presence of a saddle shaped component, and coma can be recognized as a component resembling a valley disposed between the confronting sides of a taller and a shorter ridge. Thus, when choosing the "best" coefficients corresponding to a particular error surface, special consideration is given to minimizing the effects of primary optical aberrations such as coma and astigmatism, as well as to keeping the surface representing the error as flat as possible in the center of the illuminated aperture.

The coefficient P in Equation (3) would be equal to $r_1=1/(4f)$ for an unscanned paraboloid. Any difference between the coefficient P and $\frac{1}{4}f$ will introduce astigmatic phase errors in the unscanned beam, which greatly degrade beam shape. However, some compromise adjustment is necessary to improve the performance of the surface for 30° scanning. This tradeoff is determined by observing the phase error surfaces along the profile $x=0$. The only coefficients not already specified by the least squares procedure which would affect this offset profile, i.e., P, R, and V, are adjusted to compromise the unscanned and scanned errors here. P is adjusted from $\frac{1}{4}f=0.2726$ to 0.2846, R was chosen to be 0.05, and V was found to be zero.

The phase error surfaces 38 and 40 of FIGS. 7 and 8 are monitored to help find the best values for the Q, S, and W coefficients. Any adjustments which improves the scanned error surface 40 can degrade the unscanned error surface 38, so a careful trade-off is necessary. The coefficients Q and S multiply high order terms, and therefore must be larger in magnitude to have an appreciable effect with respect to the other coefficients. The Q, S, and W coefficients have no effect on the $x=0$ or $y'=0$ profiles, but they strongly affect illumination of the corners of the reflector surface 10, and in the corners of the phase error surfaces 38 and 40 of FIGS. 7 and 8 as well. Q and S must be of opposite sign to balance each other, and S should be larger than Q in magnitude, as it multiplies a fourth order of x, where Q multiplies a term only second order in x (the magnitude of $x^2$ varies between 0 and $0.45^2$). The coefficient W multiplies a term odd in y' ($x^2y'^3$), so its effect on the error surface for positive y' values will be the opposite of that for the negative values. With this information, the coefficients are adjusted in succession to target specific areas of the phase error surfaces of the scanned and unscanned beams until a balance between the two phase error surfaces is reached.

If the unscanned phase error surface 38 demonstrates an $x^2y'$ dependence, the error surface 38 can be improved by decreasing the coefficient T from, in the present embodiment, for example, its original value of 0.2206 to 0.175. This adjustment improves the unscanned beam performance, without greatly effecting the scanned phase error. The final coefficient values are listed below in Table 1.

TABLE 1

| Coefficient | Value | Coefficient | Value | Coefficient | Value |
|---|---|---|---|---|---|
| b | .8386 | P | 0.2846 | N | 0.1836 |
| $r_1$ | 0.2726 | Q | 0.76 | T | 0.175 |
| $r_2$ | 0.0338 | R | 0.05 | U | −0.4429 |
| | | S | −5.50 | V | 0.0 |
| | | | | W | −0.80 |

FIGS. 2A–2C show the surface given by Equation (1) with the coefficients listed in Table 1, bounded by the projected aperture oval 36 shown in FIG. 6. This aperture oval 36 is the locus of aperture circles for all beams in the 60° field of view.

The final phase error surface 38 for the unscanned beam, generated as explained previously, is given in FIG. 7. This error surface 38 still reveals a large influence of the $x^2y$ or $x^2y^3$ terms. However, further attempts to correct this by adjusting coefficients T and W would increase the overall error for the 30° scanned beam severely. The primary error for the 30° scanned beam initially was a linear tilt in the offset (elevation) direction more than any other aberration. Although the magnitude of the error appeared large, its effect on the radiated beam was to steer the beam a fraction of a degree away from the desired direction. For this reason, it is necessary to use a feed point for 30° scanning that is displaced to eliminate this linear tilt in y. In the present embodiment, the feed point is moved a distance 0.0054 in y above the $y=0$ plane and then moved to perform some minor refocusing, resulting in the point $(x, y, z)=(0.4744, 0.0054, -0.0410)$. The resulting phase error surface 40, representing phase variations from a planar 30° scanned wavefront is shown in FIG. B. Note the balance of phase error in the y direction, indicating the removal of the linear tilt. For both 0° and 30° beams, coma and astigmatism are low, and the error is kept relatively flat along the central portions of the illuminated aperture.

The phase error surfaces of FIGS. 7 and 8 describe the phase distribution of the electric field at the aperture of the reflector antenna 10. As has been shown above, by observing the phase error surface for both the 30° scanned and unscanned beams, a set of coefficients can be chosen that optimize the performance of the reflector antenna for both of these beams. To substantiate that sufficiently high quality beams result at a plurality of intermediate angles, it is useful to obtain a farfield radiation pattern for each beam orientation that may be of interest. A radiation pattern in the far-field can be found by taking the Fourier transform of the field across the aperture of the reflector surface 10. The electric field samples at each point are summed across this aperture with complex exponential weighting to produce the spatial Fourier Transform, which represents the radiation pattern in the far-field.

Figure 9:
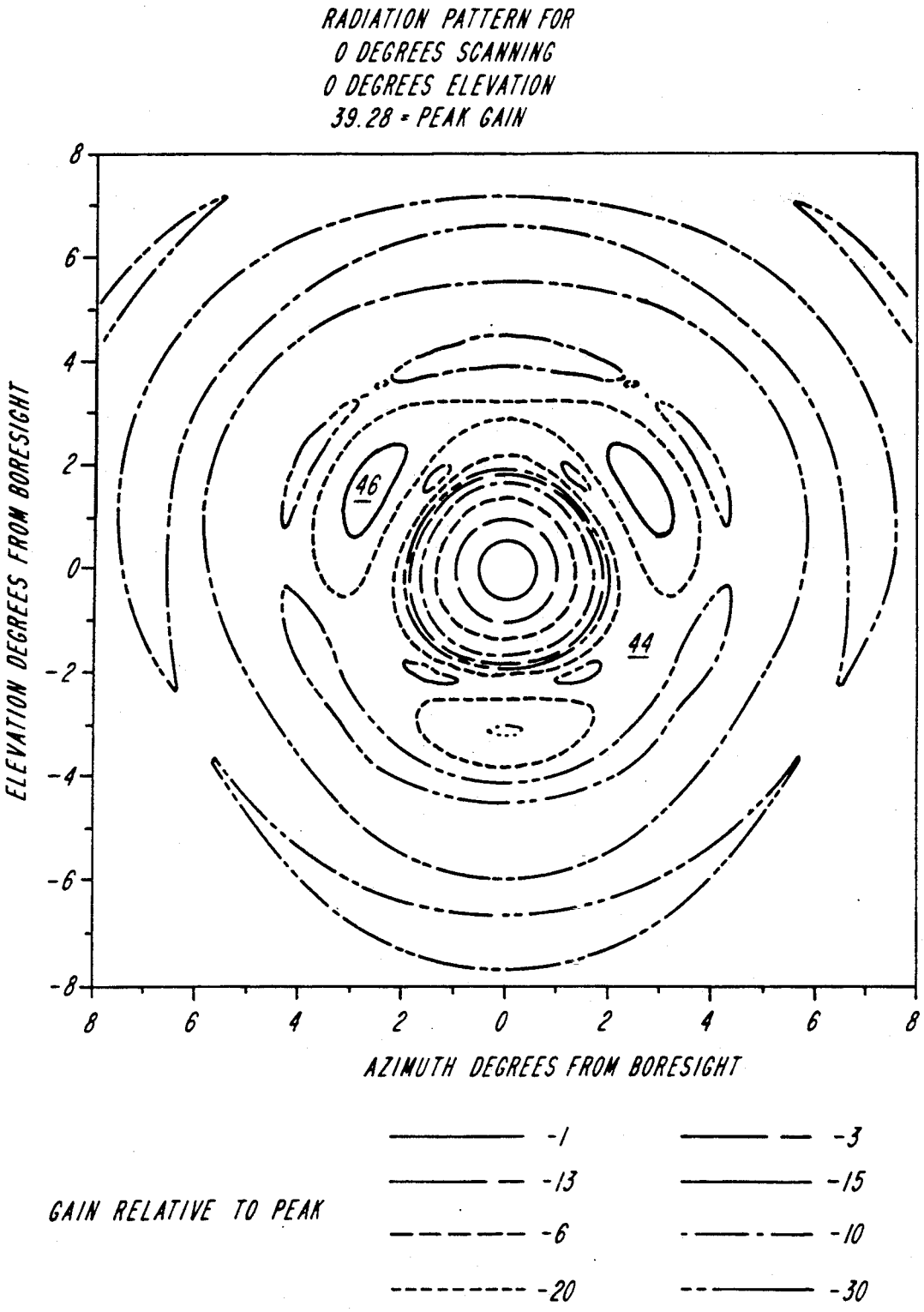
FIG. 9 is a contour plot of a radiation pattern of an unscanned beam.

FIG. 9 shows a contour plot of the radiation pattern resulting from the error surface 38 in FIG. 7. The beam 42 is well formed with deep nulls 44, and has a peak gain of 39.27 dB with respect to isotropic radiation distribution, which is only 0.22 dB below the ideal peak gain of a paraboloid of the same uniformly illuminated aperture. The highest sidelobes 46 are in unusual locations, but are 13.48 dB below the beam peak.

Figure 10:
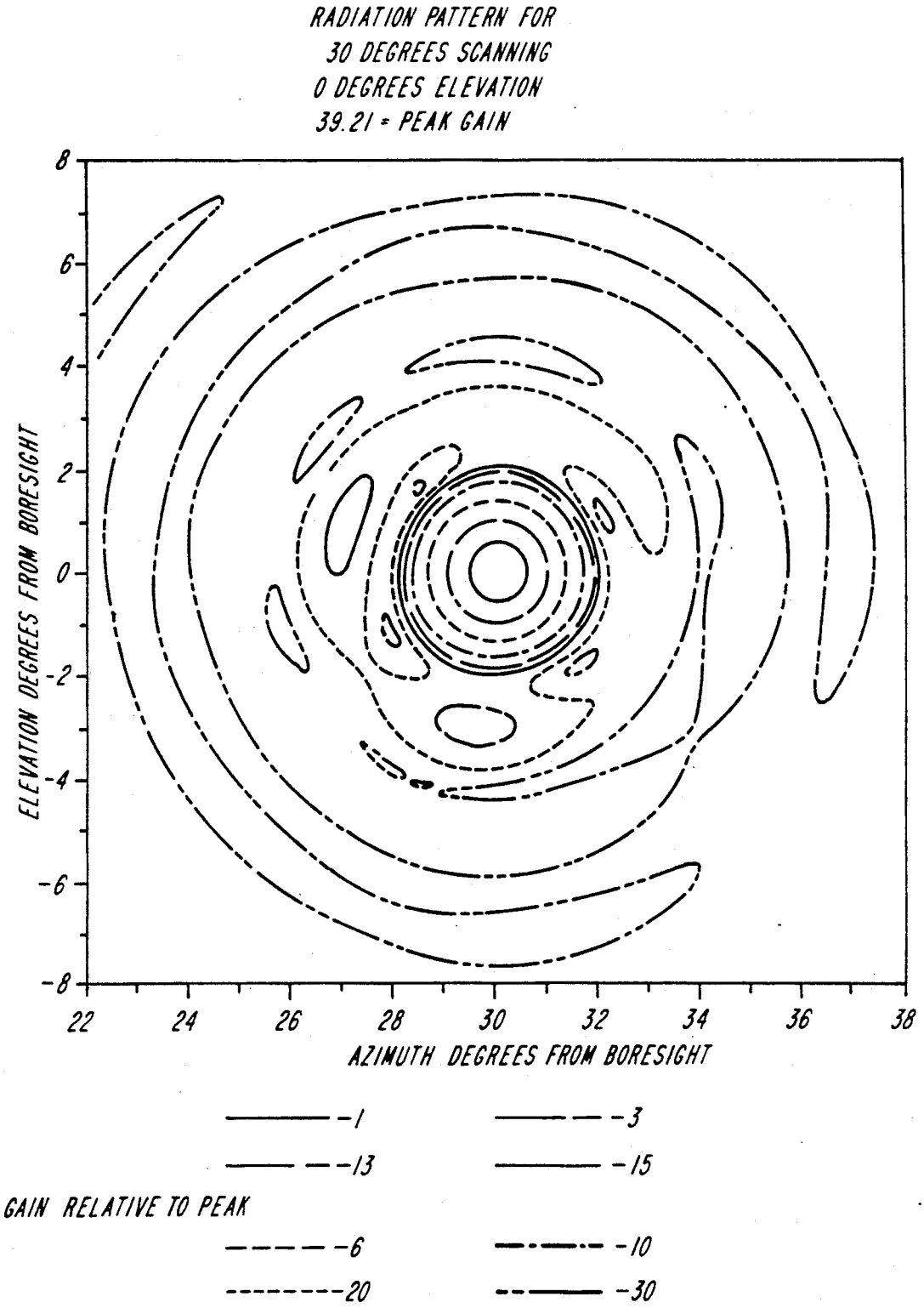
FIG. 10 is a contour plot of a radiation pattern of a 30° scanned beam.
Figure 11:
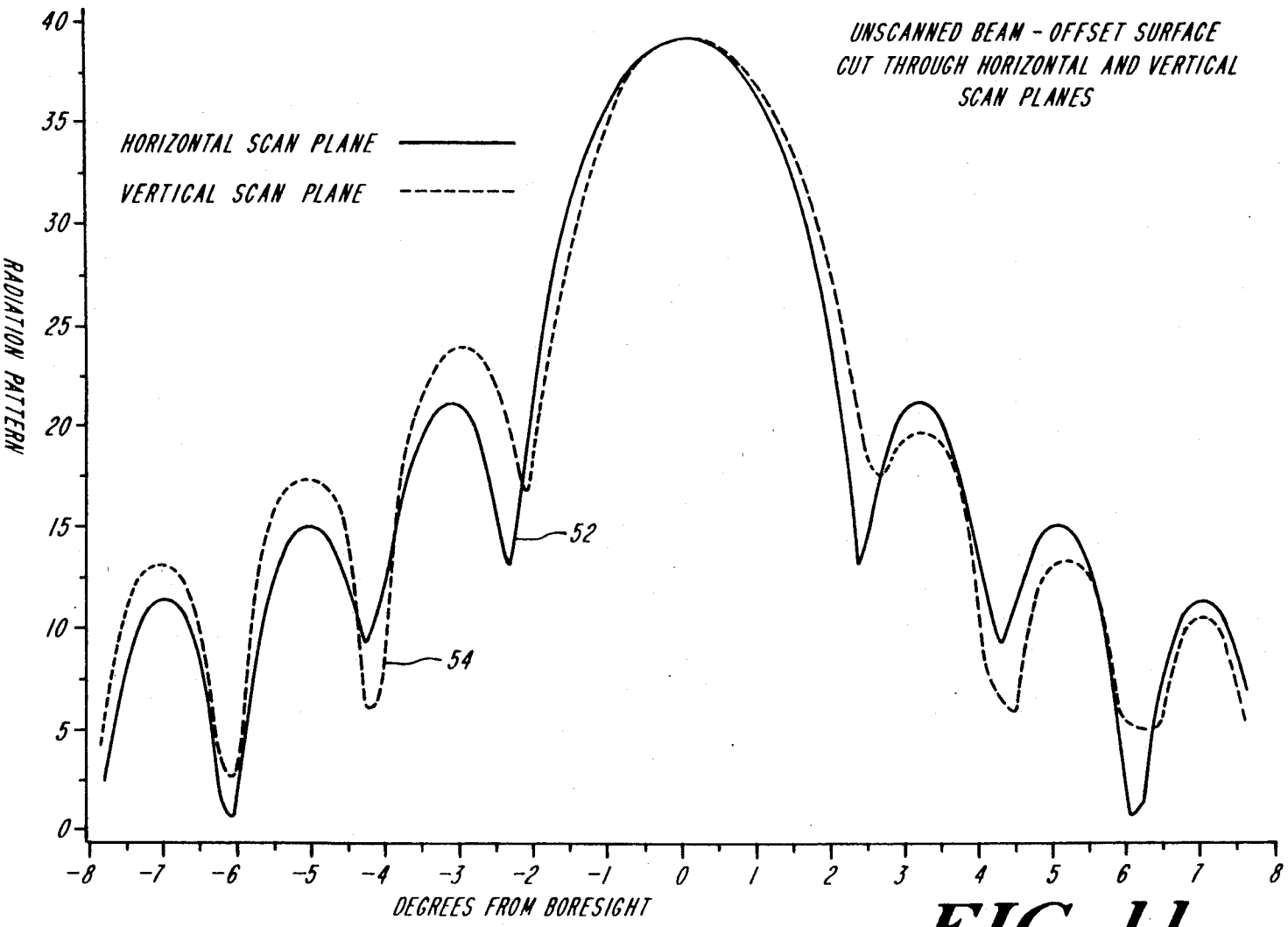
FIG. 11 is a cross-section of the contour plot of FIG. 9 through the horizontal plane of scan of an unscanned beam, and a cross-section of the contour plot of FIG. 9 through the vertical plane of scan of an unscanned beam.
Figure 12:
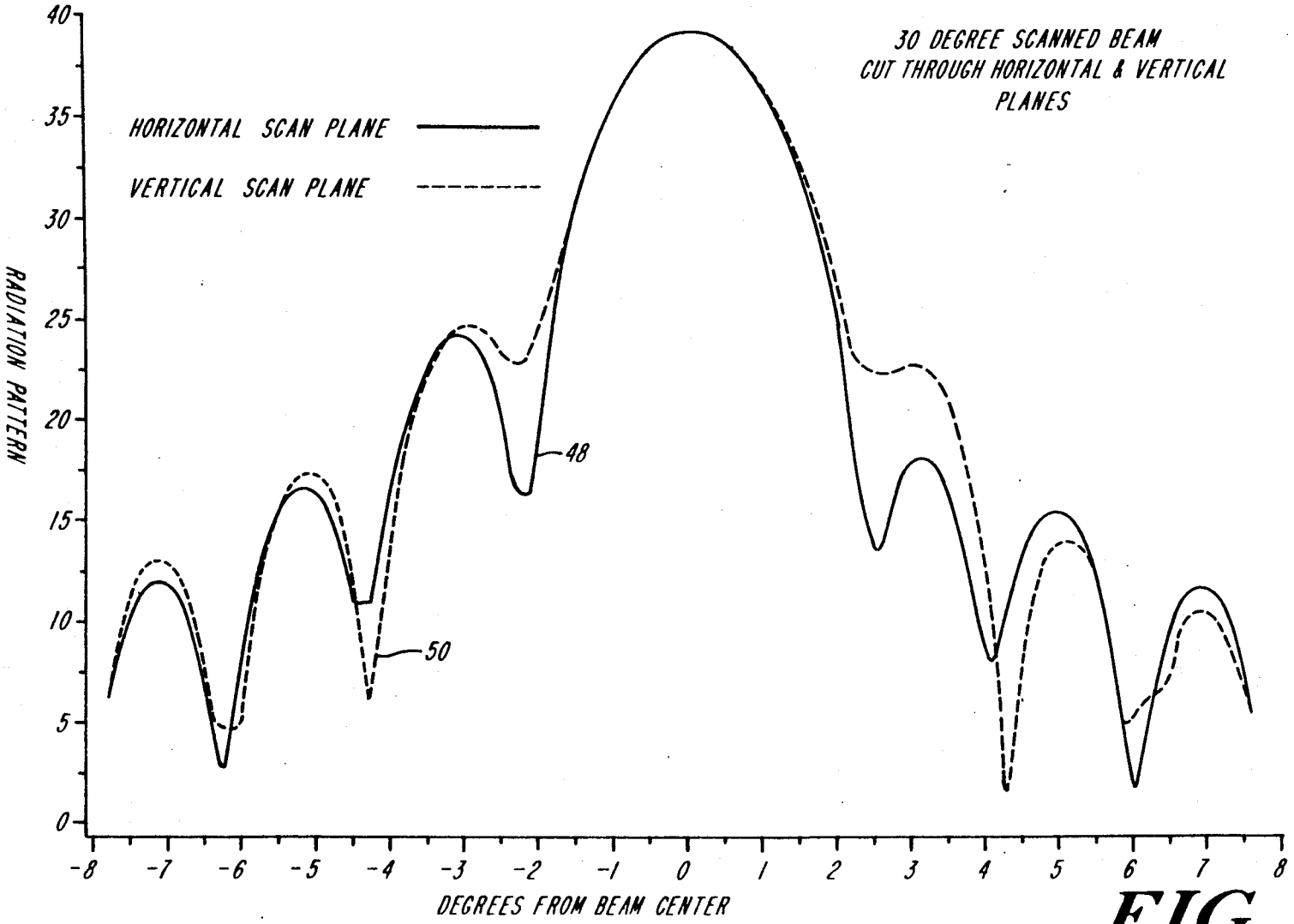
FIG. 12 is a cross-section of the contour plot of FIG. 10 through the horizontal plane of scan of a 30° scanned beam, and a cross-section of the contour plot of FIG. 10 through the vertical plane of scan of a 30° scanned beam.

FIG. 10 is a contour plot of the radiation pattern generated by the scanned phase error surface of FIG. 8, with peak gain of 39.20 dB, and the highest sidelobe level at 13.99 dB below beam peak. FIGS. 11 and 12 each show two-dimensional cross-sections taken through the horizontal and vertical scan planes of the reflector surface 10 for the unscanned and 30° scanned beam radiation patterns of FIGS. 9 and 10, respectively.

Once performance is optimized for the 0° and 30° scanned beams, the performance of the reflector surface 10 is verified over its full field of view. To do this, it is necessary to find the feed point for a given angle of scanning which provides substantially the best quality beam. However, the problem of finding the best feed point is complicated by the fact that the feed points do not lie in the y=0 plane, as they do in the symmetric case as disclosed in Applicant's copending patent application cited above.

The 30° scanned feed point Was initially found by parameterizing along a ray extended at a 30° angle to the z-axis, as shown in FIG. 5. The optimal feed points for intermediate angles should therefore lie on a similar ray extended at the desired scan angle from the Z-axis. Since the unscanned feed point lies below the y=0 plane, this implies that the optimal points for intermediate angles will also lie below this plane, and the above-described ray must be projected down by some amount in the Y-direction. There exists a plane defined by the unscanned and original scanned feed points and the intersection of the surface with the Z-axis; this is chosen to be the plane onto which the ray will be projected. For the region between the unscanned and scanned feed points, this plane represents intermediate y values, ensuring that the Y-coordinate of any intermediate feed point will be below the y=0 plane and above the unscanned feed point. The resulting projected ray will represent the locus of possible feed points which form the desired angle with the z-axis and lie an appropriate distance below the y=0 plane. By observing the error surfaces generated by various points along this ray, an optimum feed point for each scan angle is chosen which minimizes the resulting error surface. Further adjustment can be made by changing the incident angle of the ray from the value of the desired scan angle. This will remove any tilt in the plane of scan which may be evident in the error surface. The Y-coordinate of the chosen point can also be adjusted away from the above-described plane, but this did not improve the errors.

FIG. 3 shows the projection of the locus of feed points, referred to as a focal arc 20, onto the X-Z plane with respect to the surface profile at y=0. FIG. 4 shows this same locus of points projected onto the X-Y plane, showing the negative y values of these points.

The surface of the preferred embodiment performs well over the full field of view, and in some cases even better than the original scan angles of 0° and 30°. Table 2 shows the full field-of-view performance from 0° to 30°, including the feed point, the center of the illuminated aperture circle on the reflector surface, the peak gain, and the highest sidelobe level for each beam scanned. Due to the symmetry of the antenna about the Y-Z plane, the corresponding values for the scan angles from 0° to −30° are identical when the values of x in the table are multiplied by −1.

TABLE 2

| Scan Angle | Feed point ($x_f$, $y'_f$, $z_f$) | Center of Aperture | Peak Gain (dB) | Sidelobe Lev. (dB) |
|---|---|---|---|---|
| 0° | (0.0000, −0.0226, 0.0073) | $x_c$ = 0.00 | 39.27 | −13.48 |
| 5° | (0.0803, −0.0188, 0.0000) | $x_c$ = 0.03 | 39.29 | −13.41 |
| 10° | (0.1607, −0.0150, −0.0075) | $x_c$ = 0.06 | 39.31 | −13.37 |
| 15° | (0.2395, −0.0113, −0.0140) | $x_c$ = 0.10 | 39.34 | −13.31 |
| 20° | (0.3193, −0.0075, −0.0210) | $x_c$ = 0.15 | 39.36 | −13.48 |
| 25° | (0.3979, −0.0038, −0.0300) | $x_c$ = 0.19 | 39.34 | −13.96 |
| 30° | (0.4744, 0.0054, −0.0410) | $x_c$ = 0.20 | 39.21 | −13.99 |

Figure 13:
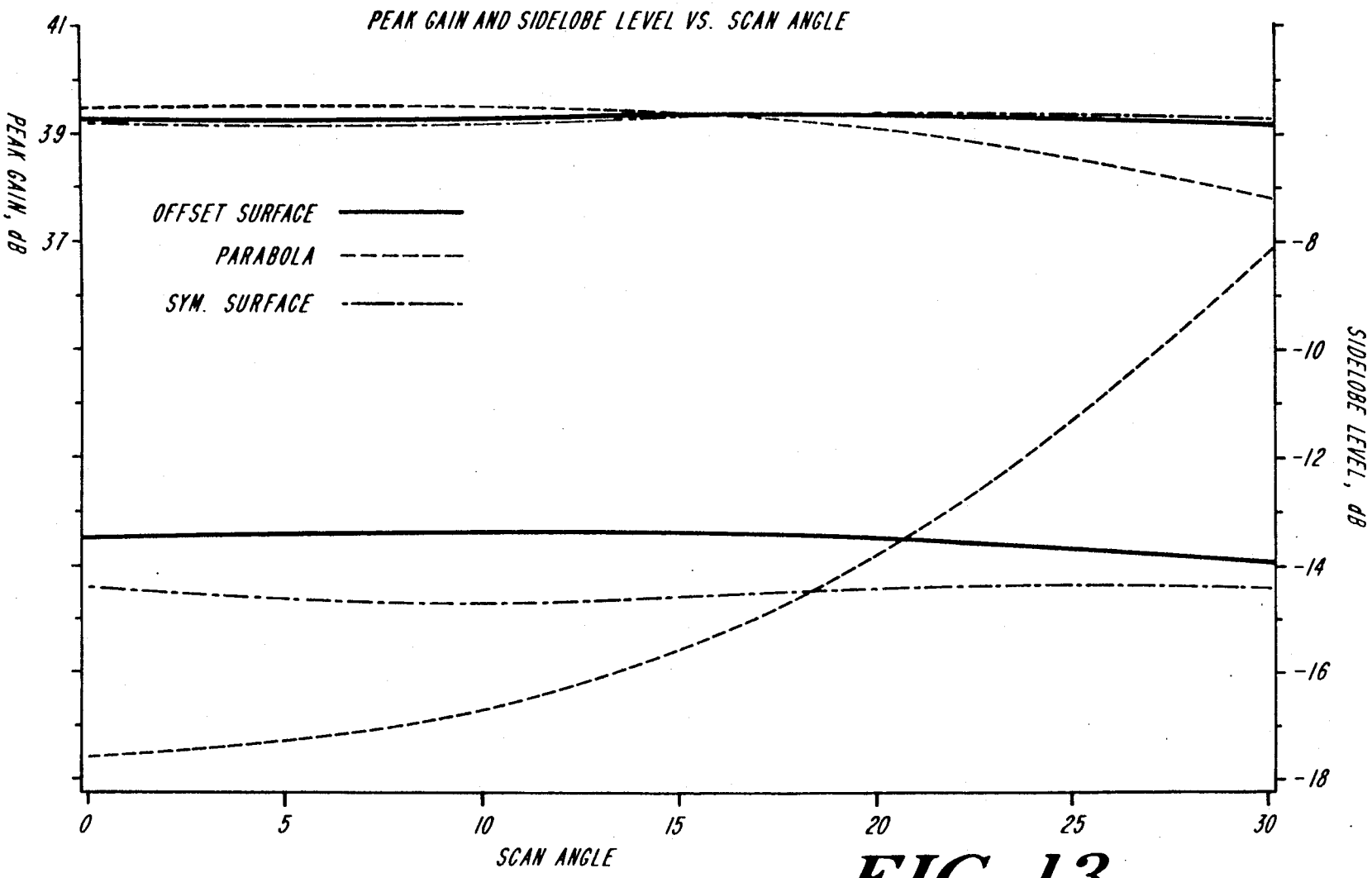
FIG. 13 is a plot of both peak gain versus scan angle and sidelobe level versus scan angle for the offset reflector surface of the invention, a symmetric reflector surface, and a comparable paraboloidal reflector surface.

FIG. 13 shows the peak gain versus scan angle, using the scale on the left side of the graph to represent peak gain in dB, and highest sidelobe level versus scan angle, using the right side of the graph to represent highest sidelobe level, for the offset reflector surface of the invention. These curves are superimposed over the performance curve of a paraboloid with an equally sized illuminated aperture and a focal length f=0.92, and a symmetric reflector surface with an equally sized illuminated aperture from Applicant's copending application Ser. No. 07/370,701. The horizontal axis represents scan angle. The optimal source points for the paraboloid are found using the same methods used for the offset surface of the present invention, except the feed points are all located on the X-Z plane. The performance of the offset reflector is relatively constant across the field of view, remaining close to 39 dB from 0° to 30°, and is therefore superior to the parabola at the greater scanning angles, i.e., from 20° to 30°.

It is also useful to compare the aperture efficiency and the degree of aberration of the offset surface to that of the parabolic torus reflector. The offset surface of the invention illuminates an area of $\pi r^2=0.1963$ for the desired illuminated aperture diameter of 0.5. The total reflector area defined by the locus of these circular apertures from −30° to +30° as shown in FIG. 6 is $(0.5)(0.4)+\pi r^2=0.3963$, giving an aperture efficiency of 49.54%. A torus reflector, using the same performance parameters as the offset surface, would have a circular profile in the X-Z plane with radius $R_5=2f=\frac{1}{2}r_1=1.834$. A portion of the surface centered at x=f=0.92 is illuminated to generate a beam scanned 30° away from the Z-axis. If this torus illuminates an aperture of diameter D=0.5, the total reflector area necessary for ±30° scanning will be $(0.5)(1.834)+\pi r_2=1.113$, resulting in a surface 2.8 times as large, and an aperture efficiency of only 17.64%; clearly less than the 49.54% aperture efficiency of the offset surface of the invention.

The phase errors associated with this torus embodiment with a radius R of 1.834 are less than those present in the offset scanning surface of the invention. However, if the dimensions of the torus reflector are altered to yield the same 49.5% aperture efficiency, the resulting phase errors are not only larger in magnitude, but are spherical in nature, which causes an unacceptable amount of beam degradation.

It is also useful to compare the performance of the offset reflector antenna of the present invention to that of the symmetric antenna disclosed in copending U.S. patent application Ser. No. 07/370,701. The peak gain for the offset reflector is as good or better than the peak gain for the symmetric reflector, while the sidelobe level is between 0.5 and 1.0 dB higher for the offset reflector. This is due to a slightly larger amount of coma in the offset reflector's phase errors, which are more difficult to suppress due to the asymmetry of the offset reflector geometry.

As a further feature of the invention, the offset reflector antenna exhibits good vertical scanning performance. The feed points are selected for vertically scanned beams using a similar method as was used to select the horizontal scan feed points: estimate the proper location, translate in x and y until the beam peak points in the desired direction, and then refocus along the central ray to the illuminated circle center until the global phase errors are minimized. This was done for beams scanned in elevation at 0° horizontal scanning and for combinations of horizontal and vertical scanning.

Figure 14:
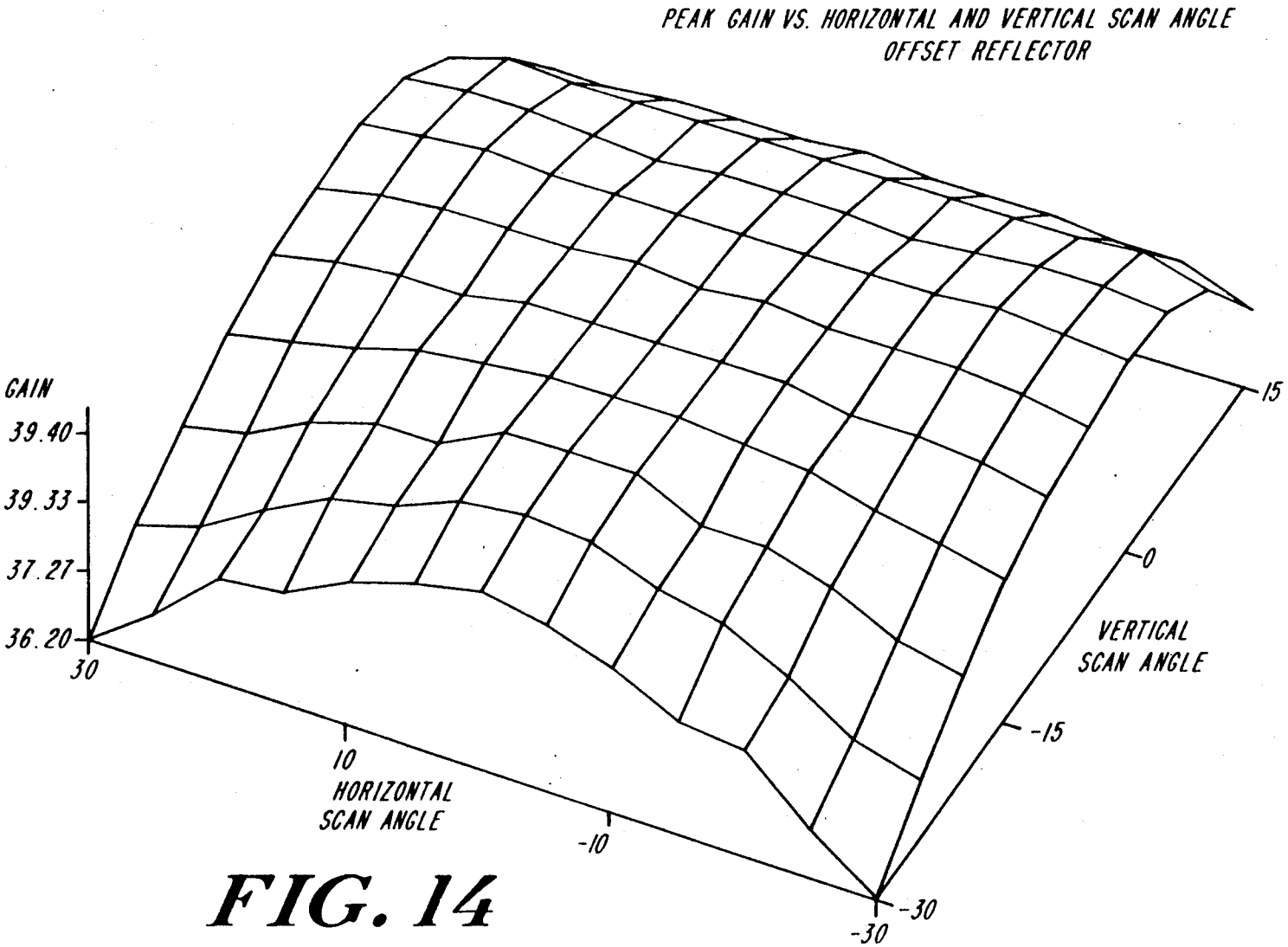
FIG. 14 is a plot of peak gain versus horizontal and vertical scan angles across the entire two-dimensional ±30° by −30° to +15° field of view.
Figure 15:
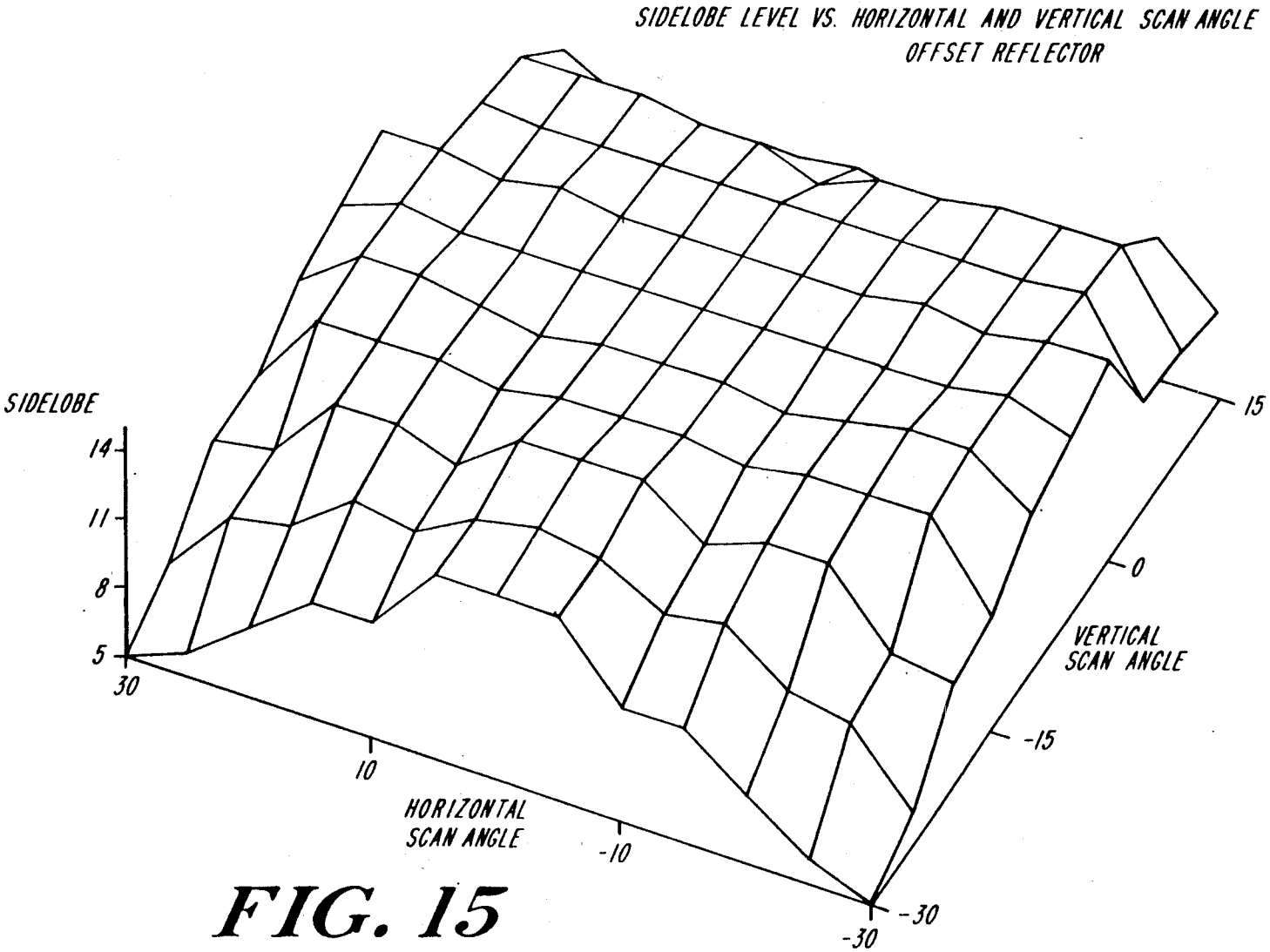
FIG. 15 is a plot of first sidelobe level versus horizontal and vertical scan angles across the entire two-dimensional ±30° by −30° to 15° field of view.

FIGS. 14 and 15 show the peak gains and highest sidelobe levels respectively for beams within the same ±30° horizontal scanning range as above, and with a vertical scanning range of −30° to +15°. Each data point on these plots was obtained by optimizing a phase surface, and then plotting the peak gain and sidelobe level for an associated radiation pattern as a function of the vertical and horizontal scan component for each scan angle within the combined scanning range. The uniformity of levels shows that most beams scanned anywhere within this scanning range are relatively focused and well-formed. Only at extremely negative vertical scan angles and corners does the performance degrade. Unfortunately, for large negative vertical scan angles, the feeds block the aperture, diminishing some of the advantage of the offset configuration. However, it must be noted that this two-dimensional scanning is not possible with any other type of single reflector surface except a spherical cap, for which every feed blocks its own beam. A torus reflector, though acceptable for horizontal scanning, performs poorly for vertical scanning.

The reflector antenna of the invention is shaped differently from the usual paraboloid antenna. It is formed by combining attributes of a paraboloid oriented to direct rays in an unscanned direction with attributes of a pair of identical paraboloids oriented to direct rays ±30° away from the unscanned direction. The surface of the antenna is represented by a 12-term, sixth-order equation, where the coefficients of the equation are found using a least square analysis and an error minimization technique. Scanning is performed by a plurality of feeds each disposed at an optimum location for each desired scan angle.

The offset reflector has a large range of vertical scanning as well as horizontal scanning. Almost all the beams horizontally scanned can simultaneously be vertically scanned from −30° to +15°. This large two-dimensional field of view, coupled with high aperture efficiency and an offset geometry that significantly reduces feed blockage makes reflectors made according to the method of the invention superior to currently employed scanning reflector systems.

The blockage which occurs in the symmetric reflector embodiment is substantially reduced for the offset reflector embodiment, while performance remains comparable. Peak gain is comparable, although the first sidelobe level is slightly higher for the offset embodiment. As was shown, tapering of the aperture distribution allows for much lower sidelobe levels. A parabolic torus reflector using the same dimensions must be nearly three times larger to scan ±30°.

Other modifications and implementations will occur to those skilled in the art without departing from the spirit and the scope of the invention as claimed. Accordingly, the above description is not intended to limit the invention except as indicated in the following claims.

What is claimed is:

1. An offset unitary reflector antenna characterized by a single boresight axis and a scan plane, said antenna including a reflector surface and a feed arc including a plurality of feeds disposed within a focal region of said reflector surface, the shape of said reflector surface being determined by a method comprising the steps of:

forming a first three-dimensional coordinate system of mutually orthogonal X, Y, and Z axes for representing said unitary antenna surface as a function z of x and y in three-dimensional space, where the boresight axis coincides with the Z axis, and the scan plane coincides with a plane formed by the X and Z axes;

forming a second three-dimensional coordinate system of mutually orthogonal X', Y', and Z' axes translated by an offset displacement such that $(x', y', z')=(x, y-y_0, z)$, where $y=y_0$ is chosen to be the central plane of the offset antenna surface;

forming a pair of superimposed, identical imaginary paraboloids, each with a focal length;

placing the vertex of each imaginary paraboloid at equally and oppositely disposed points about the boresight axis of the unitary antenna surface, without rotating either paraboloid;

rotating each imaginary paraboloid about its vertex, within the scan plane, and to an equal angular extent towards the boresight axis until the respective slopes of said imaginary paraboloids are substantially equal at a point of intersection on the Z' axis, to provide a pair of intersecting imaginary paraboloids; and determining the shape of said reflector surface by forming a surface $z=z_1+z_2+z_3$, where $$z_1=-b+r_1x^2+r_2x^4,$$

$$z_2=Py'^2+Qx^2y'^2+Ry'^4+Sx^4y'^2, \text{ and}$$

$$z_3=Ny'+Tx^2y'+Ux^4y'+Vy'^3+Wx^2y'^3,$$

said surface z being characterized by having a concavity in closely-fitting relationship with said pair of intersecting imaginary paraboloids, said concavity being in closest-fitting relationship, over a region of each imaginary paraboloid that at least includes said point of intersection, such that the coefficients b, $r_1$, and $r_2$ are determined, and wherein the shape of said surface z is further determined by adjusting the coefficients P, Q, R, S, N, T, U, V, and W using error minimization techniques so as to achieve a desired level of optical performance of said reflector surface.

2. The offset unitary reflector antenna of claim 1 wherein the coefficients N, T, and U are determined by taking the first derivative of said surface z with respect to y' within said central plane, and conforming the resulting planar curve to a planar curve that results from taking the derivative of said pair of imaginary paraboloids with respect to y' within said central plane using an error minimization technique.

3. The offset unitary reflector antenna of claim 1 wherein the disposition of said feed arc including said plurality of feeds includes the step of:

determining the location of each of said plurality of feeds with respect to said three-dimensional surface z for each selected scan angle of said antenna using a phase error minimization technique.

4. The offset unitary reflector antenna of claim 3, wherein said phase error minimization technique includes the steps of:

forming a phase error surface over the illuminated aperture of said antenna for each proposed feed position;

evaluating said phase error surface for indicia of optical aberrations in a beam provided by the cooperation of a feed in a proposed feed position and said reflecting surface; and fixing said feed in said proposed position if said indicia of optical aberrations are acceptable.

5. The offset unitary reflector antenna of claim 2, wherein said phase error minimization technique includes the steps of:

forming a phase error surface over the illuminated aperture of said antenna for both a beam oriented in the boresight direction of said reflector surface, and a beam oriented at the intended maximum scan angle for said reflector surface;

evaluating each phase error surface for indicia of optical aberration of each beam; and changing the numerical value of at least one of said coefficients until said indicia of optical aberration are acceptable.

6. An offset unitary reflector antenna with a wide field of view, characterized by having a single boresight axis, a scan plane, and a central plane perpendicularly displaced by an offset displacement, said antenna including a reflector surface and a feed arc disposed within a focal region of said reflector surface, the shape of said reflector surface being determined by a method comprising the steps of:

forming a first three-dimensional coordinate system of mutually orthogonal X, Y, and Z axes for representing said unitary antenna surface as a function z of x and y in three-dimensional space, where the boresight axis coincides with the Z axis, and the scan plane coincides with a plane formed by the X and Z axes;

forming a second three-dimensional coordinate system of mutually orthogonal X', Y', and Z' axes translated by an offset displacement such that $(x', y', z') = (x, y - y_0, z)$, where $y = y_0$ is chosen to be the central plane of the offset antenna surface;

rotating each of two coincident imaginary paraboloidal surfaces, each having a respective focal point and a respective vertex disposed at a point along the single boresight axis, in the scan plane and about their respective focal points such that their respective vertices move away from one another by an angular displacement equal to one-half of the field of view;

translating each paraboloidal surface in the scan plane without rotation until the paraboloidal surfaces are perpendicular to a line parallel to and displaced from the boresight axis by the offset displacement, to provide a pair of intersecting imaginary paraboloids;

determining the shape of said reflector surface by forming a surface $z = z_1 + z_2 + z_3$, where $$z_1 = -b + r_1x^2 + r_2x^4,$$

$$z_2 = Py'^2 + Qx^2y'^2 + Ry'^4 + Sx^4y'^2, \text{ and}$$

$$z_3 = Ny' + Tx^2y' + Ux^4y' + Vy'^3 + Wx^2y'^3,$$

said surface z being characterized by having a concavity in closely-fitting relationship with said pair of intersecting imaginary paraboloids, said concavity being in closest-fitting relationship, over a region of each imaginary paraboloid that at least includes said point of intersection, such that the coefficients b, $r_1$, and $r_2$ are determined, and wherein the shape of said surface z is further determined by adjusting the coefficients P, Q, R, S, N, T, U, V, and W using error minimization technique so as to achieve a desired level of optical performance of said reflector surface.

7. The offset unitary reflector antenna of claim 6 wherein the coefficients N, T, and U are determined by taking the first derivative of said surface z with respect to y' within said central plane, and conforming the resulting planar curve to a planar curve that results from taking the derivative of said pair of intersecting imaginary paraboloids with respect to y' within said central plane using an error minimization technique.

8. The offset unitary reflector antenna of claim 6 wherein the disposition of said feed arc including said plurality of feeds includes the step of:

determining the location of each of said plurality of feeds with respect to said three-dimensional surface z for each selected scan angle of said antenna by using a phase error minimization technique.

9. The offset unitary reflector antenna of claim 8, wherein said phase error minimization technique includes the steps of:

forming a phase error surface over the illuminated aperture of said antenna for each proposed feed position;

evaluating said phase error surface for indicia of optical aberrations in a beam provided by the cooperation of a feed in a proposed feed position and said reflecting surface; and fixing said feed in said proposed position if said indicia of optical aberrations are acceptable.

10. The offset unitary reflector antenna of claim 7, wherein said phase error minimization technique includes the steps of:

forming a phase error surface over the illuminated aperture of said antenna for both a beam oriented in the boresight direction of said reflector surface, and a beam oriented at the intended maximum scan angle for said reflector surface;

evaluating each phase error surface for indicia of optical aberration of each beam; and changing the numerical value of a least one of said coefficients until said indicia of optical aberration are acceptable.

11. An offset unitary reflector antenna with a wide field of view, characterized by having a single boresight axis, a scan plane, and an offset displacement perpendicular to the scan plane, said antenna including a reflector surface and a feed arc disposed within a focal region of said reflector surface, wherein a first three-dimensional coordinate system of mutually orthogonal X, Y, and Z axes represents said unitary antenna surface as a function z of x and y in three-dimensional space, where the boresight axes coincides with the Z axis, and the scan plane coincides with a plane formed by the X and Z axes, and wherein a second three-dimensional coordinate system of mutually orthogonal X', Y40 , and Z' axes is translated by an offset displacement such that $(x', y', z')=(x, y-y_0, z)$, where $y=y_0$ is chosen to be the central plane of the offset antenna surface, the shape of said reflector surface being determined by an equation of the form:

$$z=z_1+z_2+z_3, \text{ where}$$

$$z_1=-b+r_1x^2+r_2x^4,$$

$$z_2=Py'^2+Qx^2y'^2+Ry'^4+Sx^4y'^2, \text{ and}$$

$$z_3=Ny'+Tx^2y'+Ux^4y'+Vy'^3+Wx^2y'^3,$$

said surface z being characterized by having a region of concavity in closely-fitting relationship with a pair of intersecting imaginary paraboloids, where the respective slopes of said intersecting imaginary paraboloids are substantially equal at a point of intersection, said region of concavity being in closest-fitting relationship over a region of each imaginary paraboloid of said pair that at least includes said point of intersection, such that the coefficients b, $r_1$, and $r_2$ are determined, and the shape of said surface z being further determined by the coefficients P, Q, R, S, N, T, U, V, and W, which coefficients having been determined using a phase error minimization technique so as to achieve a desired level of optical performance of said reflector surface.

12. The offset unitary reflector antenna of claim 11 wherein the coefficients N, T, and U are determined by taking the first derivative of said surface z with respect to y' within said central plane, and conforming the resulting planar curve to a planar curve that results from taking the derivative of said pair of intersecting imaginary paraboloids with respect to y' within said central plane using an error minimization technique.

13. The offset unitary reflector antenna of claim 11 wherein the shape of said surface z is modified for enhanced optical performance by adjusting the coefficients P, Q, R, S, V, and W using a phase error minimization technique.

14. The offset unitary reflector antenna of claim 11 wherein said pair of imaginary paraboloids is formable by rotating each of two coincident imaginary paraboloidal surfaces, each having a respective focal point and a respective vertex disposed at a point along the single boresight axis, in the scan plane and about their respective focal points such that their respective vertices move away from one another by an angular displacement equal to one half of the field of view;

and then translating each paraboloidal surface in the scan plane without rotation until the paraboloidal surfaces are perpendicular to a line parallel to and displaced from the boresight axis by the offset displacement.

* * * * *

UNITED STATES PATENT AND TRADEMARK OFFICE

CERTIFICATE OF CORRECTION

PATENT NO. : 5,175,562

DATED : December 29, 1992

INVENTOR(S) : Carey M. Rappaport

It is certified that error appears in the above-identified patent and that said Letters Patent is hereby corrected as shown below:

On the Title Page, Item [57]:

In the Abstract, line 6, "sufrace" should read --surface--.

Col. 2, line 29, "$r_2z^2$" should read $z_1$=--b + $r_1x^2 + r_2x^4$

Col. 3, line 21, "Order" should read --order--.

Col. 3, line 55, "vie" should read --view of--.

Col. 3, line 56, "y=0 to" should read --y=0 corresponding to--.

Col. 5, line 27, "$Z_1$" should read --$z_1$--.

Col. 6, line 38, "$\leq$ x $\leq$" should read --$\leq$ x $\leq$--.

Col. 7, line 14, "scanned base" should read --scanned beam--.

Col. 8, line 63, "FIG. B" should read --FIG. 8--.

Col. 9, line 44, "Was" should read --was--.

Col. 10, line 64, "$R_5$=" should read --$R_t$=--.

Col. 11, line 1, "$\pi r_2$" should read --$\pi r^2$--.

Col. 11, line 6, "radius R" should read --radius $R_t$--.

Col. 15, line 26, "Y40" should read --Y'--.

Signed and Sealed this

Nineteenth Day of April, 1994

Bruce Lehman

*Attest:*

*Attesting Officer*

BRUCE LEHMAN

*Commissioner of Patents and Trademarks*